US008803013B2

(12) United States Patent
Mohtasham et al.

(10) Patent No.: US 8,803,013 B2
(45) Date of Patent: Aug. 12, 2014

(54) ANTI-TAMPER CAM SYSTEM

(75) Inventors: Medi Mohtasham, Astley (GB); Hamed Faridfar, Atherton (GB)

(73) Assignee: Idem Safety Switches Limited, Hindley Green, Wigan (GB)

( * ) Notice: Subject to any disclaimer, the term of this patent is extended or adjusted under 35 U.S.C. 154(b) by 161 days.

(21) Appl. No.: 13/436,363

(22) Filed: Mar. 30, 2012

(65) Prior Publication Data

US 2012/0247162 A1 Oct. 4, 2012

(30) Foreign Application Priority Data

Apr. 1, 2011 (GB) ..... 1105575.3

(51) Int. Cl.
*H01H 27/00* (2006.01)

(52) U.S. Cl.
USPC ..... 200/43.04; 200/329; 200/334; 200/533

(58) Field of Classification Search
USPC ..... 200/43.04, 43.01, 43.16, 329, 334
See application file for complete search history.

(56) References Cited

U.S. PATENT DOCUMENTS

| | | | | |
|---|---|---|---|---|
| 5,516,993 | A | 5/1996 | Wecke et al. | |
| 5,703,339 | A | 12/1997 | Rapp et al. | |
| 5,777,284 | A * | 7/1998 | Mohtasham | 200/43.04 |
| 6,037,551 | A | 3/2000 | Fukui et al. | |
| 6,118,087 | A * | 9/2000 | Fukui | 200/43.04 |
| 6,307,167 | B1 * | 10/2001 | Kajio et al. | 200/43.11 |
| 6,872,898 | B2 * | 3/2005 | Mohtasham | 200/43.01 |
| 7,504,597 | B2 * | 3/2009 | Shimazu et al. | 200/43.04 |
| 7,605,335 | B2 * | 10/2009 | Hiltl et al. | 200/43.04 |
| 2008/0017492 | A1 | 1/2008 | Hiltl et al. | |

FOREIGN PATENT DOCUMENTS

| | | |
|---|---|---|
| GB | 1105575.3 | 8/2011 |
| WO | WO 93/24947 | 12/1993 |

* cited by examiner

*Primary Examiner* — Kyung Lee
(74) *Attorney, Agent, or Firm* — Quarles & Brady LLP; Gavin J. Milczarek-Desai

(57) ABSTRACT

The present invention relates to an anti-tamper cam system 2 used to selectively operate a safety interlock switch 6. The cam system 2 comprising a cam 12 selectively rotatable between two positions in order to activate the switch 6. The cam 12 has a locking system 20, 22; 32*a*, 32*b* to lock the cam 12 in one of its positions. The locking system 20, 22; 32*a*, 32*b* comprises a separate mechanical locks 20, 22; 32*a*, 32*b* on each side of the cam 12, each of which must be unlocked using a dedicated key actuator 8 before the cam 12 can be rotated to its other position.

18 Claims, 10 Drawing Sheets

ANTI-TAMPER CAM SYSTEM

The present invention relates to a cam system used to selectively activate a switch and in particular, but not exclusively, switches in the form of safety interlock switches.

Safety interlock switches are usually mounted adjacent a guard door on a machine and only enable the guard door to be opened enabling access to the machine when the machine is stationary. The switch has normally closed contacts which enable power to be supplied to the machine. In order to switch the power off to stop the machine and release the lock on the door it is necessary to activate the switch to open the normally closed contacts. Activation of the switch is achieved by reciprocal movement of a spring biased cam plunger in to or out of the switch housing to open or close the contacts.

The cam plunger is displaced by the rotation of a cam, which is rotated by removal or insertion of an actuation key into the cam housing to engage in a profile on the cam. Generally the machine cannot be restarted until the key is installed in the cam mechanism, whilst removal of the key forces the normally closed contacts to open to stop the machine.

One of the drawbacks of the known cam mechanism is that it is relatively easy to rotate and it is therefore possible for the mechanism to be tampered with by insertion of an activator to directly rotate the cam. It is the object of the present invention, to alleviate this drawback. It is a further object to provide an improved cam mechanism whose cam will only be rotated when a specific, authorised activator key is inserted.

In accordance with the present invention there is provided a cam system used to selectively activate a switch by movement of a cam plunger between a first and second position, the plunger being moved between said first and second position by rotation of a cam between a corresponding first and second position of the cam, wherein the cam system comprises said cam, a locking system for locking said cam in said first cam position and a release system for unlocking the locking system enabling the cam to rotate to said second position, wherein the locking system comprises a separate mechanical lock on each side of the cam which must be unlocked by the release means before the cam can be rotated to the second position of the cam.

The release means may be adapted to release the mechanical locks simultaneously.

Each mechanical lock may comprise two separate components which must be released in sequence to enable the unlocking of the cam.

The two separate components may comprise at least one lock release and at least one locking arm, the lock release may have means to receive the release system and an abutment means to move the locking arm after it is released. The cam may comprise a locking recess on its profile and the locking arm an arm portion which releasably engages in the locking recess. The locking arm may be spring loaded.

In a preferred embodiment the cam is mounted for selective rotation on a cam pin, wherein the or each lock release is also mounted on the cam pin and is rotatable about the cam pin when the release means engages it. The locking arm may be mounted separate from the lock releases.

At least two lock releases may be provided on each side of the cam each comprising a front and an end lock release, the front and end lock releases having corresponding abutment means which engage when one of these two lock releases is rotated to move the other of the lock releases. The front and end lock releases respective means to receive the release system may be orientated at different angles, the angle may be 90°. The cam system may have means to return the cam to its initial position upon removal of the release means. The return means may comprise a return spring which acts on at least one of the lock releases and cam. The return means may also include a stop means to limit the rotation of the cam. The stop means may comprise a slot carried on the cam or lock release and a spigot which travels in the slot on the other of the lock release or cam. The spigot and slot may be provided coaxial to the rotational axis of the cam and lock release, at least one end of the slot providing an abutment for the spigot.

The release means may comprise two separate dependent arms for respectively contacting the locking system either side of the cam. The release means may also comprise a cam mover downstream of the arms, which only contacts the cam for movement thereof once the locking means is released.

By way of example only a specific embodiment of the invention will now be described with reference to the accompanying drawings, in which.

Figure 1:
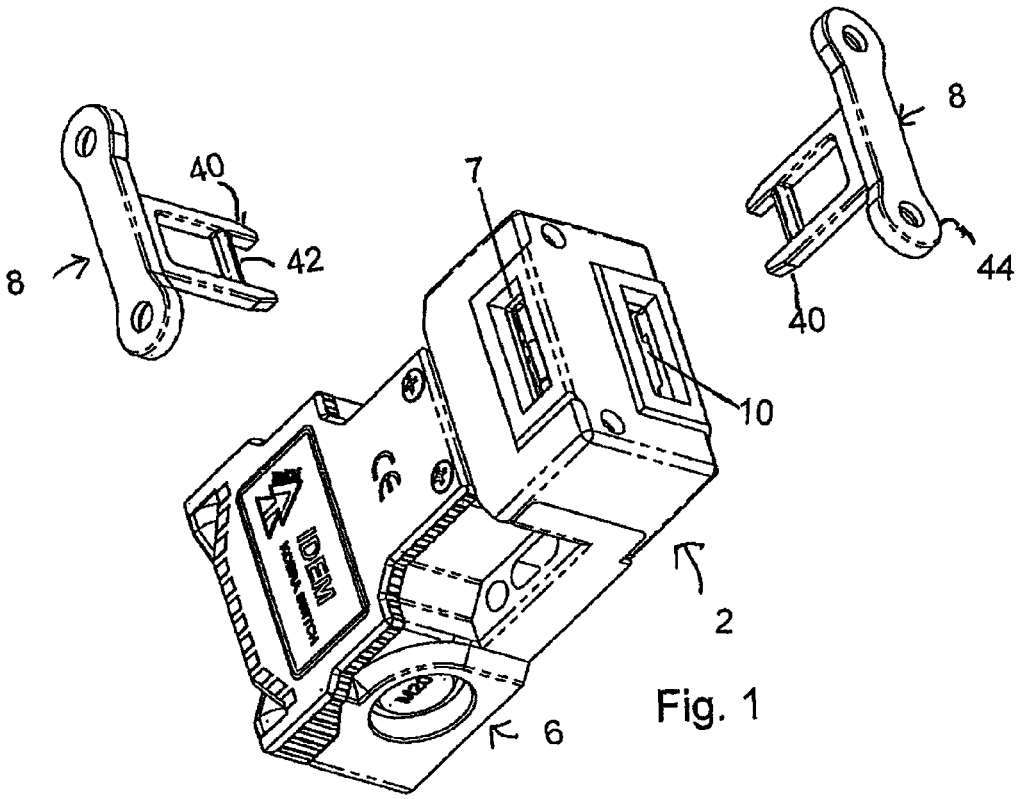
FIG. 1 is a perspective view of a cam system constructed in accordance with the invention mounted to a safety switch.
Figure 2:
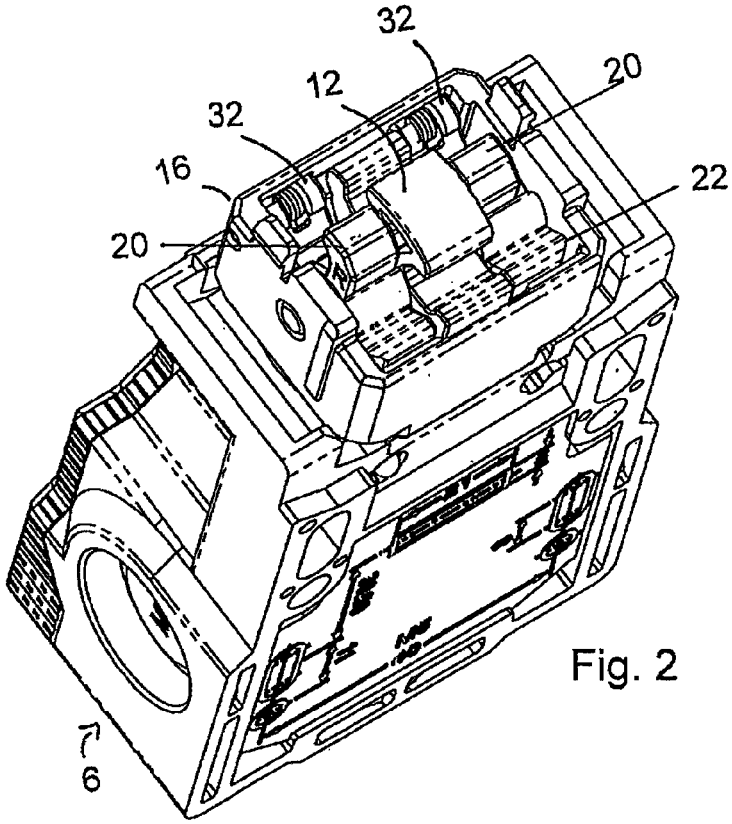
FIG. 2 is an end view of the cam housing of FIG. 1 with end of cam housing removed to show cam mechanism therein.

As best illustrated in FIGS. 1 and 2 the cam system comprises a housing 2 which contains a cam mechanism 4 which is operably mounted to a switch 6. The cam mechanism is moved using a key actuator 8 which can be inserted via a front 7 or end 10 opening to the cam housing 2. The plurality of insertion openings 7, 10 enable the mounting of the cam system at a variety of geometric locations, whilst still enabling easy access to the operator for insertion of the key actuator by selection of the front or end insertion opening 7, 10.

Figure 3:
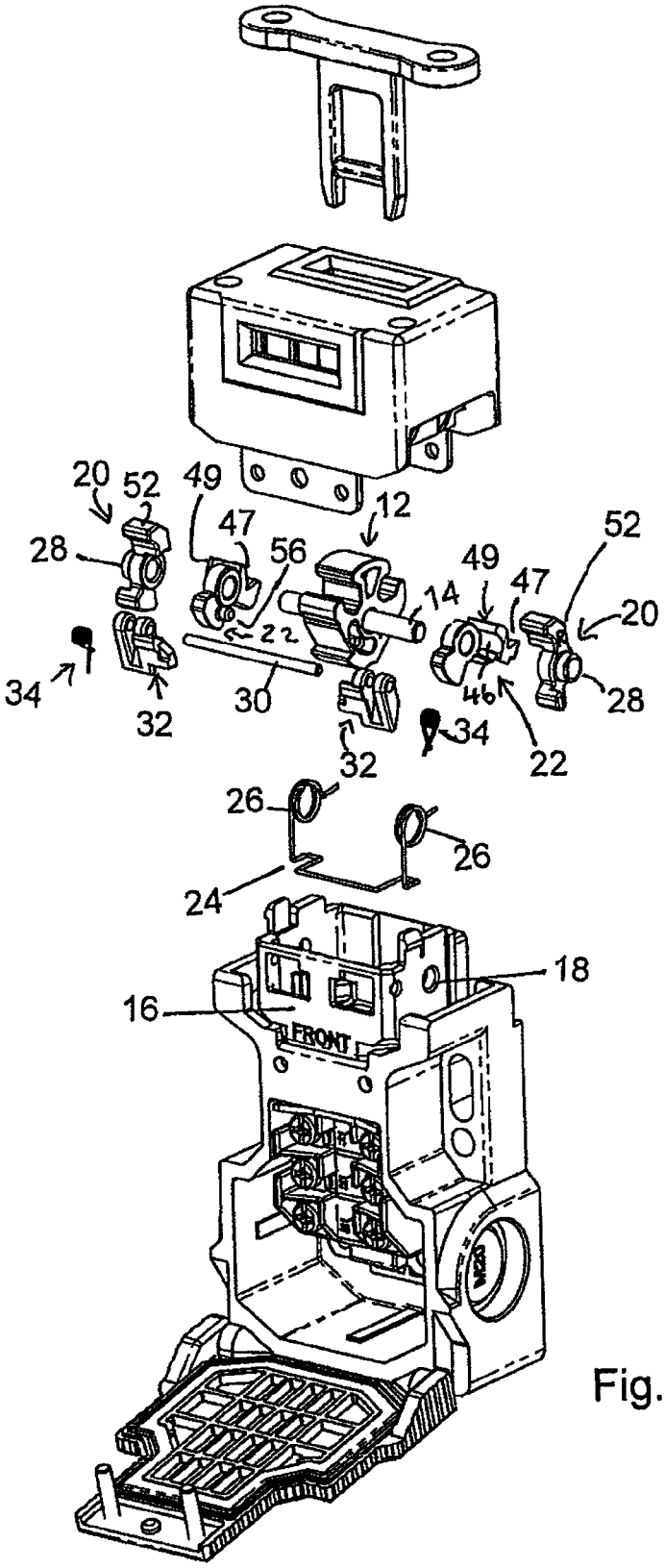
FIG. 3 is an exploded view of the cam mechanism of FIG. 2.
Figure 4:
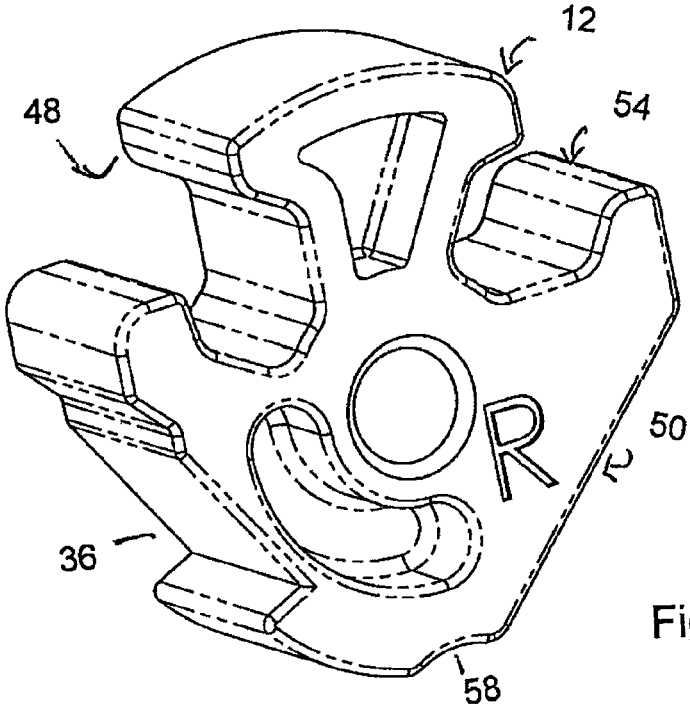
FIG. 4 is a detail of the cam of FIG. 3, cam pin omitted.

As best illustrated in FIGS. 2, 3 and 4 the cam mechanism 4 comprises a cam 12 rotatably mounted on a cam pin 14. The cam housing 2 comprises an inner housing 16 having a pair of concentric bores 18 through which the cam pin 14 is rigidly mounted within the inner housing 16. In addition to the cam 12 there are also selectively rotatably mounted on the cam pin 12, within the inner housing 16 a left front lock release 20 and between the left front lock release 20 and one side of the cam 12 a left end lock release 22.

A mirror image of the left front and end lock releases 20, 22 are provided on the opposite side of the cam 12, as right front and end releases 20, 22. The assembly on the cam pin 14 is completed by a cam spring 24 which has two coiled ends 26 which engage about respective annular shoulders 28 provided on each front lock release 20, remote from the cam 12, and adjacent to the inner wall of the cam inner housing 16.

In addition to the cam pin 12 a locking arm shaft 30 is also rigidly mounted in the cam inner housing 16, and parallel to the cam pin 14. This carries a pair of locking arms 32, also a mirror image of each other, one on the left and one on the right, each with a locking arm spring 34 to provide a bias to the locking arms 32.

The left and right locking arms 32 and the left and right front end lock releases 20, 22 each act to lock the cam 12 in a so-called "off" position until the various locking components are released in sequence by the insertion of the actuator key 8 in either the front or end openings 7, 10. That is when the two separate left and right sets of spring loaded rotating arms 20, 22 (each comprising the above mentioned front lock release 20 and end lock release 22) are activated by insertion of the actuator key 8 they will rotate and disengage the two separate left and right spring loaded locking arms 32 which in their normal position lock the cam 12 and prevent its rotation.

Figure 5:
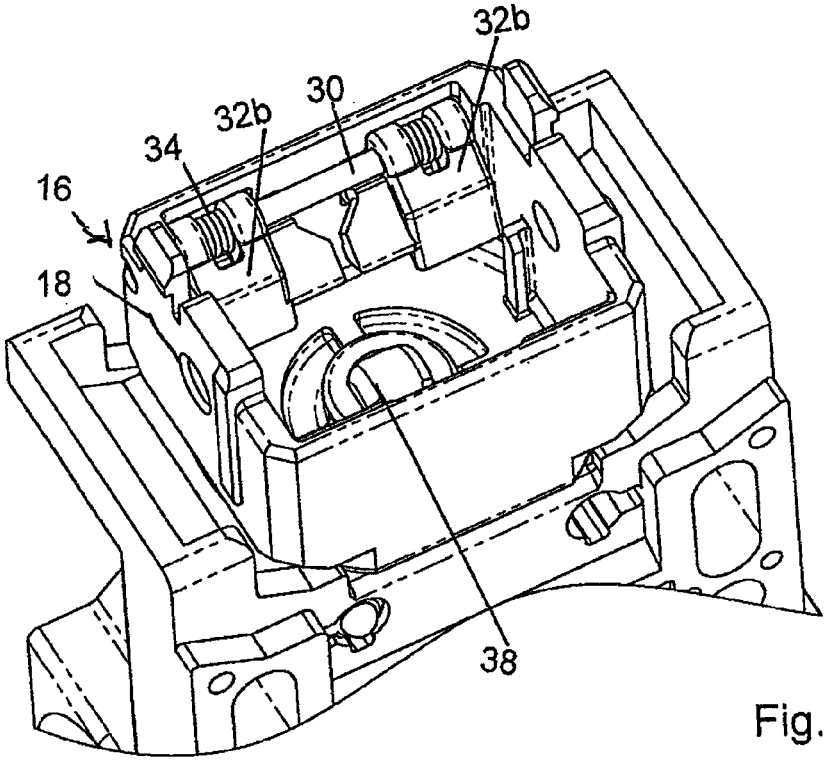
FIG. 5 is a perspective view of the cam housing, end removed to show the mounting of the locking arms, omitted from this illustration is the cam and its front and end lock releases.

Referring to FIG. 5 (in which just the locking arms 32 are illustrated within the cam housing 16 to more clearly show the structure of the locking arms 32) each locking arm comprises two arm portions, the first arm portion 32*a* of each arm 32 engage in the same recess 36 in the cam 12 profile (see FIG. 6) and the second arm portion 32*b* of each arm engage a respective front and end lock release 20, 22. The two arms 32*a*, 32*b* are rigidly connected about their rotatable mounting on locking shaft arms 30.

Figure 6:
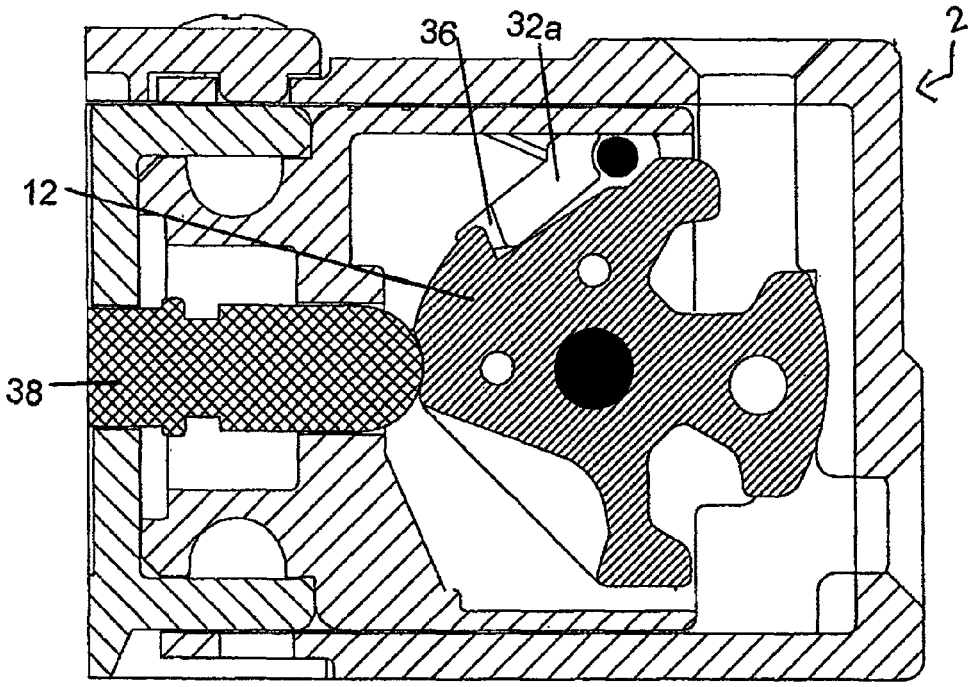
FIG. 6 is a central longitudinal sectional view of the cam housing of FIG. 1 in the condition when the key activator is not inserted and the cam is prevented from rotating by the locking arms.

Referring to FIG. 6, when the activator key 8 is not inserted in the cam housing 2, the cam 12 is prevented from rotating by the locking arm 32*a* (right and left) engaging in a recess 36 on its profile about its periphery. In this position a cam plunger 38 is held by the outer profile of the cam 12 such that it extends into the switch housing 6. In this position normally closed contacts 5 in the switch are open and normally open contacts are closed and power is not supplied to attendant machinery.

Figure 7:
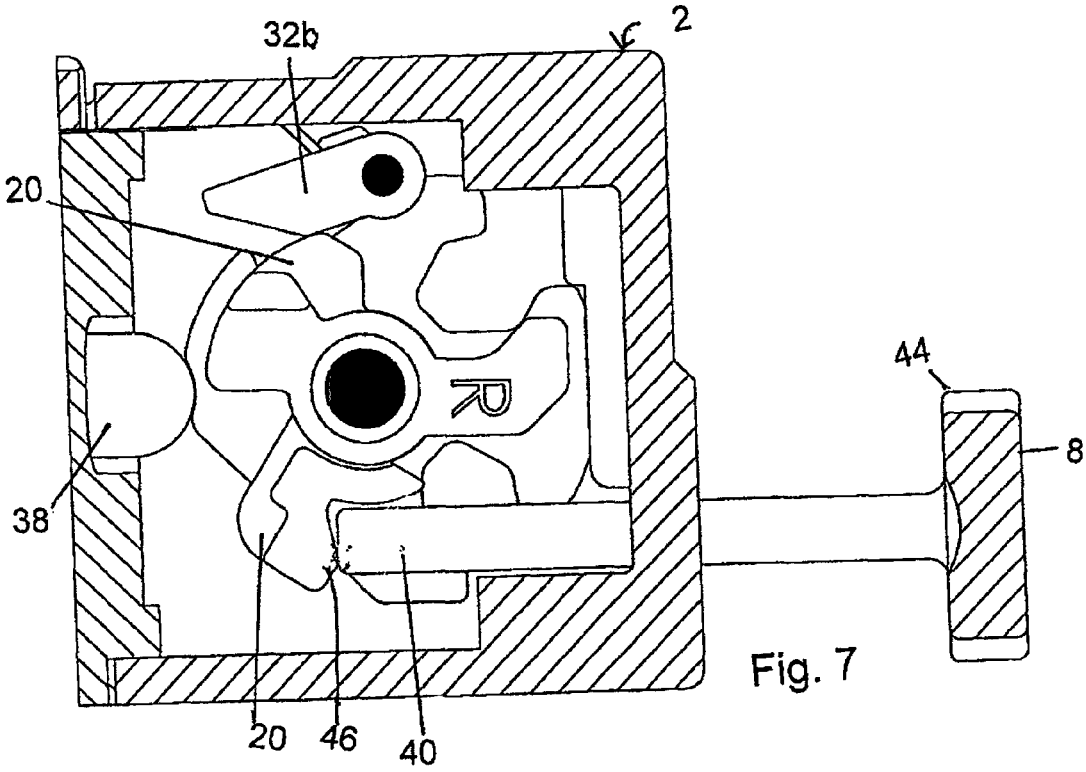
FIG. 7 is a sectional view in a plane parallel to that of FIG. 6 showing a first stage of the rotation of the cam during key activator insertion through the end of the cam housing and engagement of the activator with the end lock releases.
Figure 8:
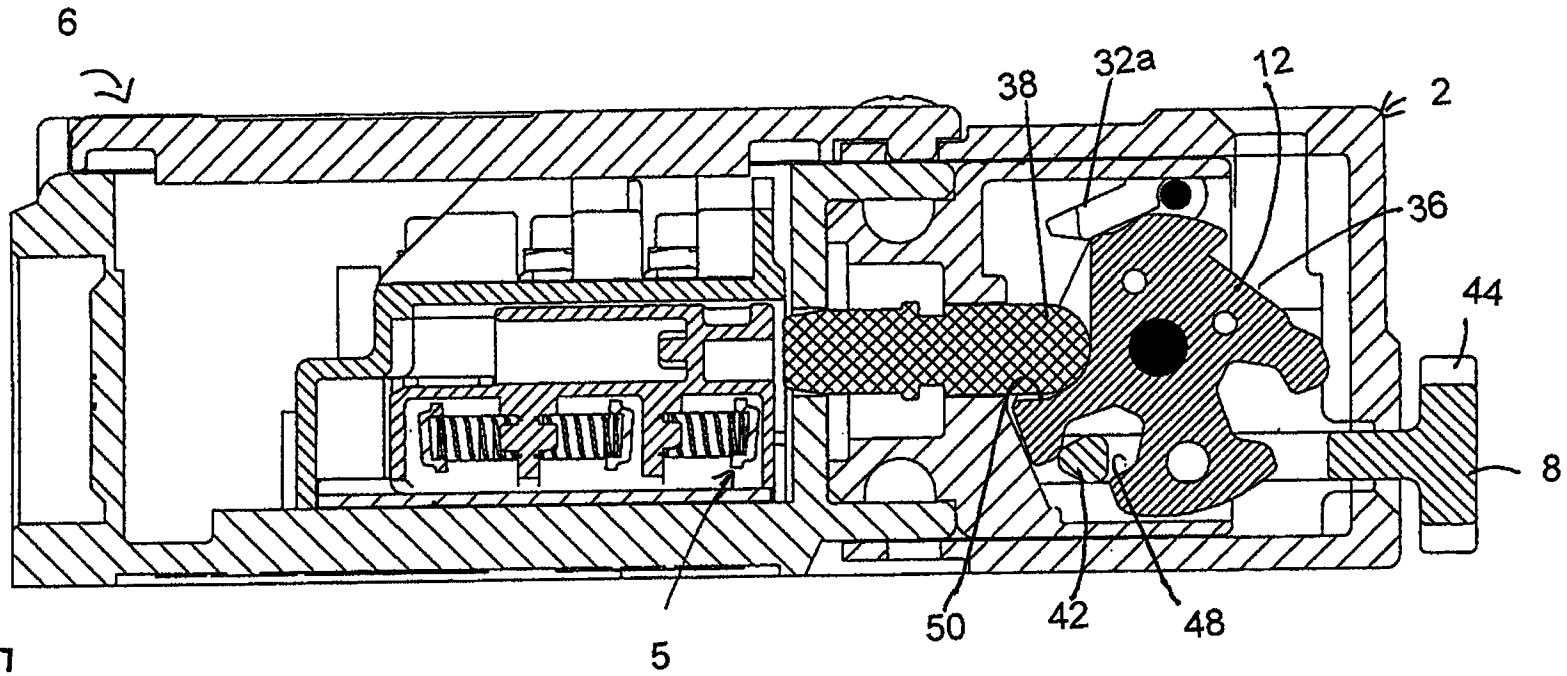
FIG. 8 is the same section as FIG. 6 but with full insertion of the activator showing its engagement with the cam.

The key actuator 8 as best illustrated in FIG. 1 is substantially the shape of a two pronged fork, each prong 40 (left and right) depends from a bridge 42 extending between the prongs 40 and the actuator is completed by an elongate handle 44. As mentioned above in use the actuator key 8 is inserted through opening 7, 10 in the cam housing 2 to rotate the cam 12 and to activate the switch 6. As illustrated in FIGS. 7 and 8 the activation of the switches requires a number of steps. In these figures the actuator key 8 is inserted via the end opening 10 and in this position as the actuator key 8 enters the cam housing 2 the left and right prongs 40 initially engage the respective left and right end lock releases 22. Each end lock release 22 comprises a first arm 46 which carries on its end a trough 47 for receipt of the respective prongs 40. The trough also extends outwardly from the lock release to provide an abutment shoulder 49. As the actuator key 8 is further inserted the end lock releases 22 are rotated about their mount on cam pin 14, by the prongs 40 engagement in the trough 47 pushing the end lock releases 22 about their mounting on the cam pin 14. The rotation of the end releases 22 cause locking arms 32*b*, which rest thereon, to overcome their spring force and rotate with the releases 22, This forces the other portion of the locking arms 32*a* to lift out of their engagement in the recess 36 in the cam 12 and therefore releases the cam 12 for rotation. Further insertion of the actuator key 8 enables bridge 42 of the key 8 (as best illustrated in FIG. 8) to engage in slot 48 provided in the cam's profile, this causes the cam 12 to rotate bringing a further recess 50 in its profile towards the cam plunger 38. The spring force biasing the cam plunger out of the switch housing 6 allows the cam plunger to move out of the switch housing 6 into the cam profile to engage in its recess 50.

This enables normally closed contacts in the switch to close and normal open contacts to open and power to be restored to the machine.

Figure 9:
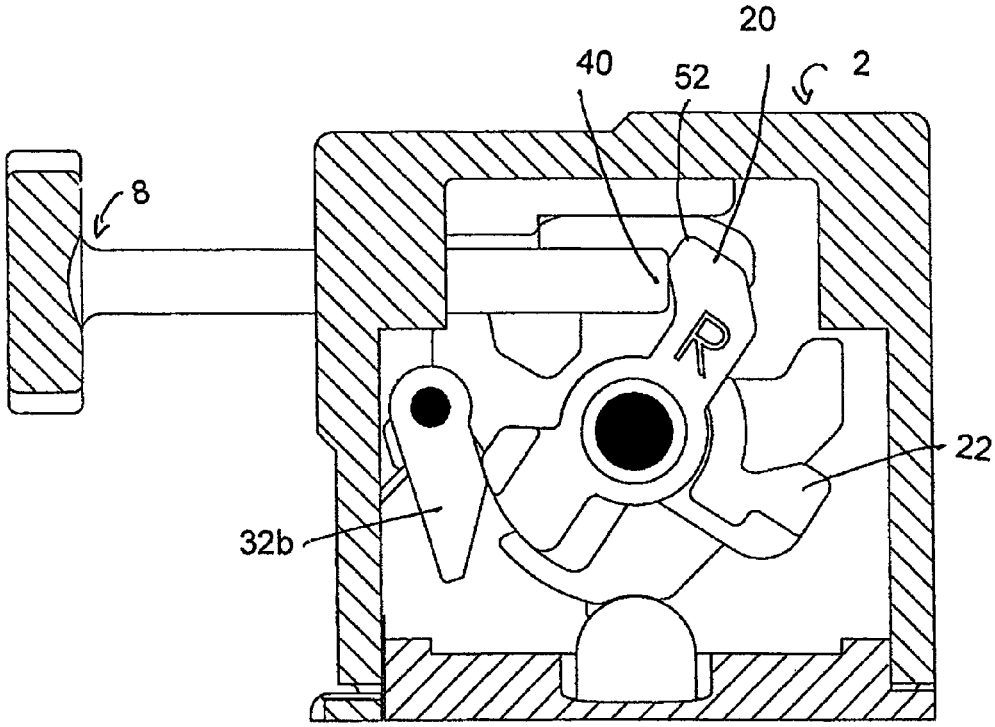
FIG. 9 is the same section as FIG. 7 but showing an alternative route for insertion of the activator via the front end of the cam housing, the activator shown as being partially inserted and contacting the front lock release of the cam.
Figure 10:
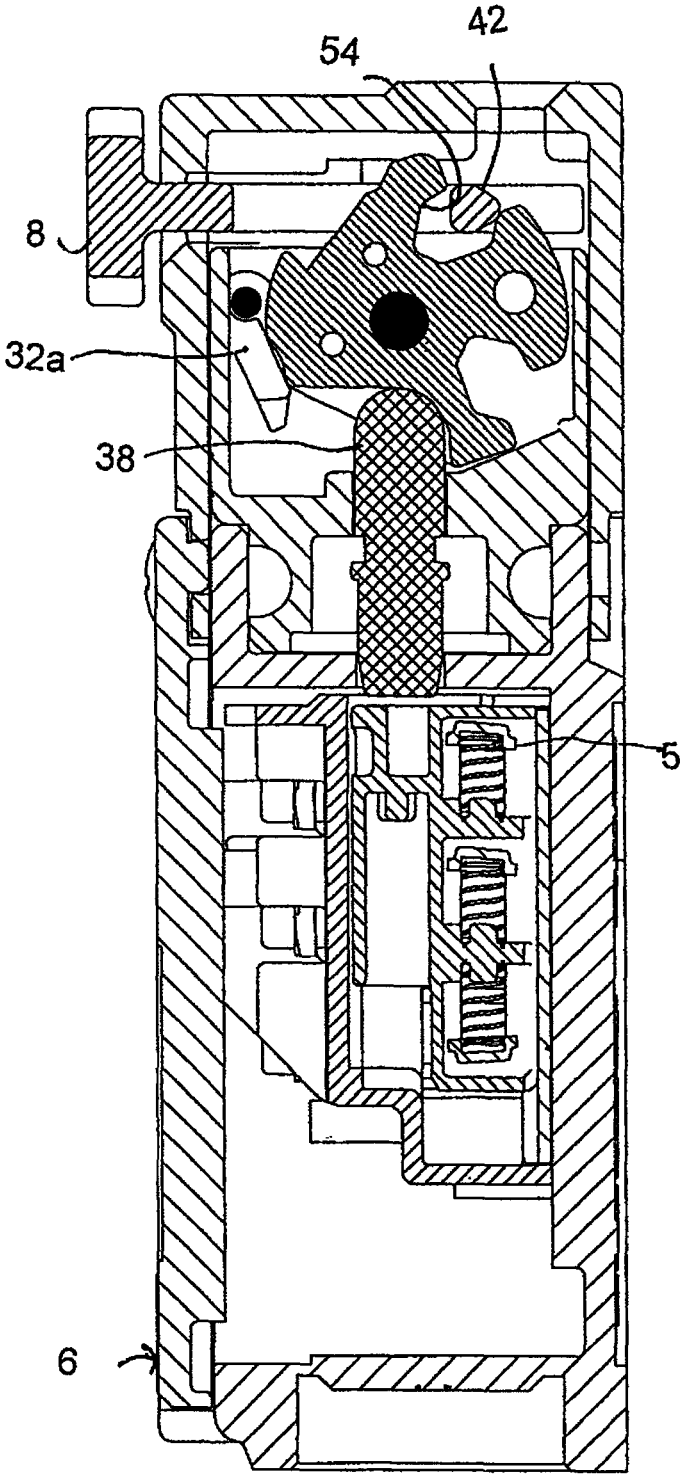
FIG. 10 is similar to FIG. 8 but for the front end insertion of the activator.

FIGS. 9 and 10 illustrate the release of the cam 12 for rotation during front entry through opening 7 of the cam housing of the key actuator. In this instance the left and right springs 40 engage respective left and right front lock releases 20. Each front lock release 20 carries a curved arm 52 and the respective prong 40 engages in the curved portion thereof to rotate the front lock release 20. As the front lock release arms 52 rotate they engage the abutment shoulder 49 of the end lock releases 22 and this causes the end lock releases to rotate therewith. This as before will rotate the locking arm portions 32*b* and cause removal of the locking arm portions 32*a* from the locking recess 36 in the cam 12 enabling the cam 12 to rotate when bridge portion 42 of the key actuator 8 engages in a second slot 54 provided in the cam profile during further insertion of the key actuator. This as before enables the cam plunger 38 to move out of the switch housing 6 and engage in recess 50 on the cam 12, enabling the contacts to switch and the power to be restored to the machine.

Figure 11:
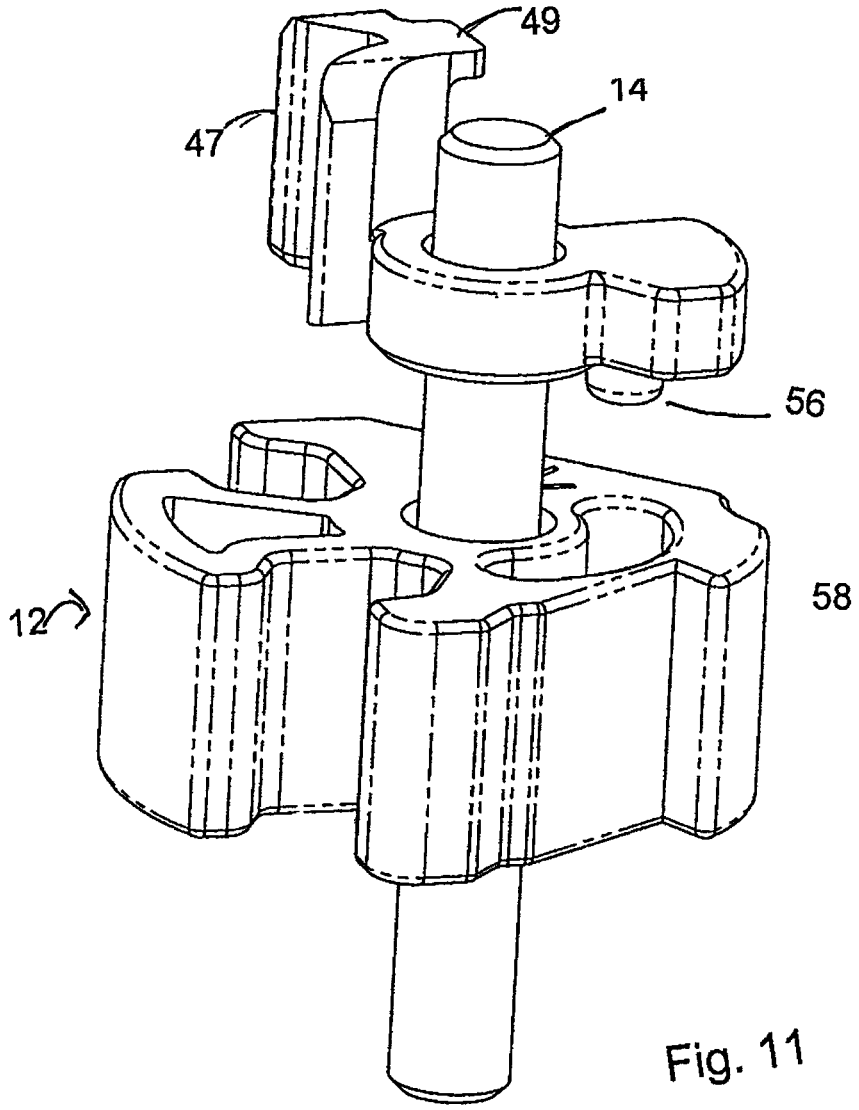
FIG. 11 is an exploded detail of the cam and one of its end lock releases to illustrate their interaction.
Figure 12:
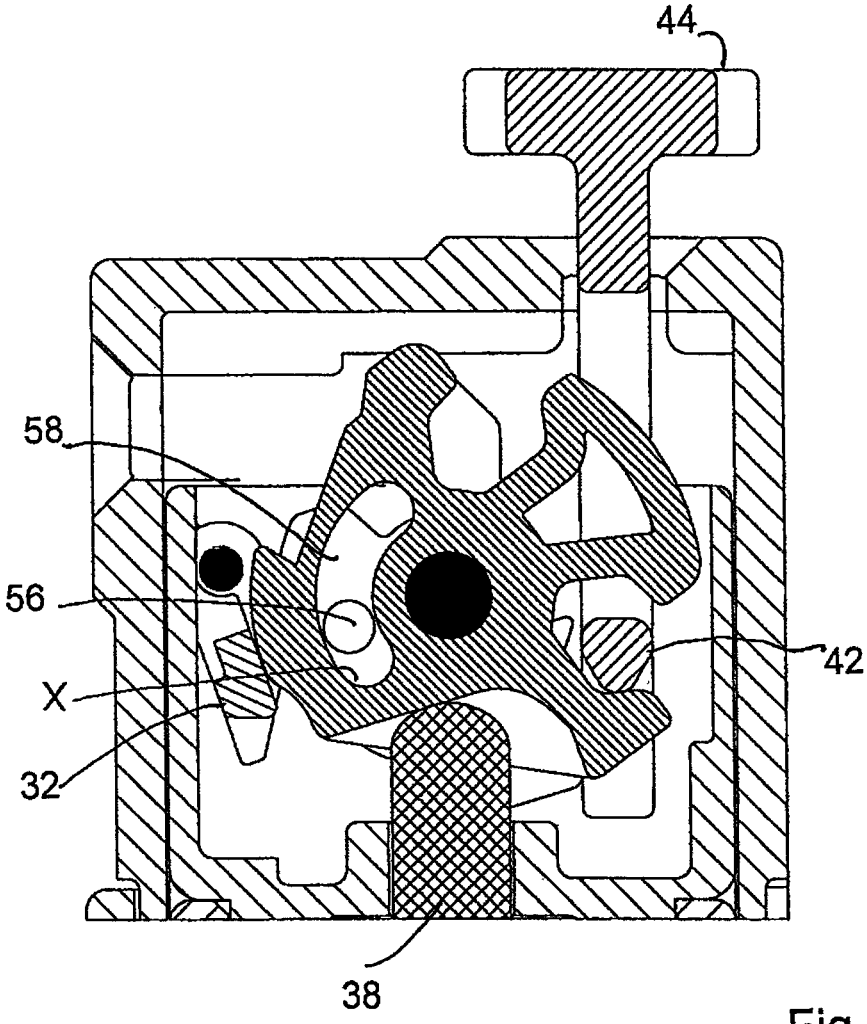
FIG. 12 is similar to FIG. 8 but has been further sectioned to show the engagement of the end lock release in a side profile on the cam, activator partially inserted.
Figure 13:
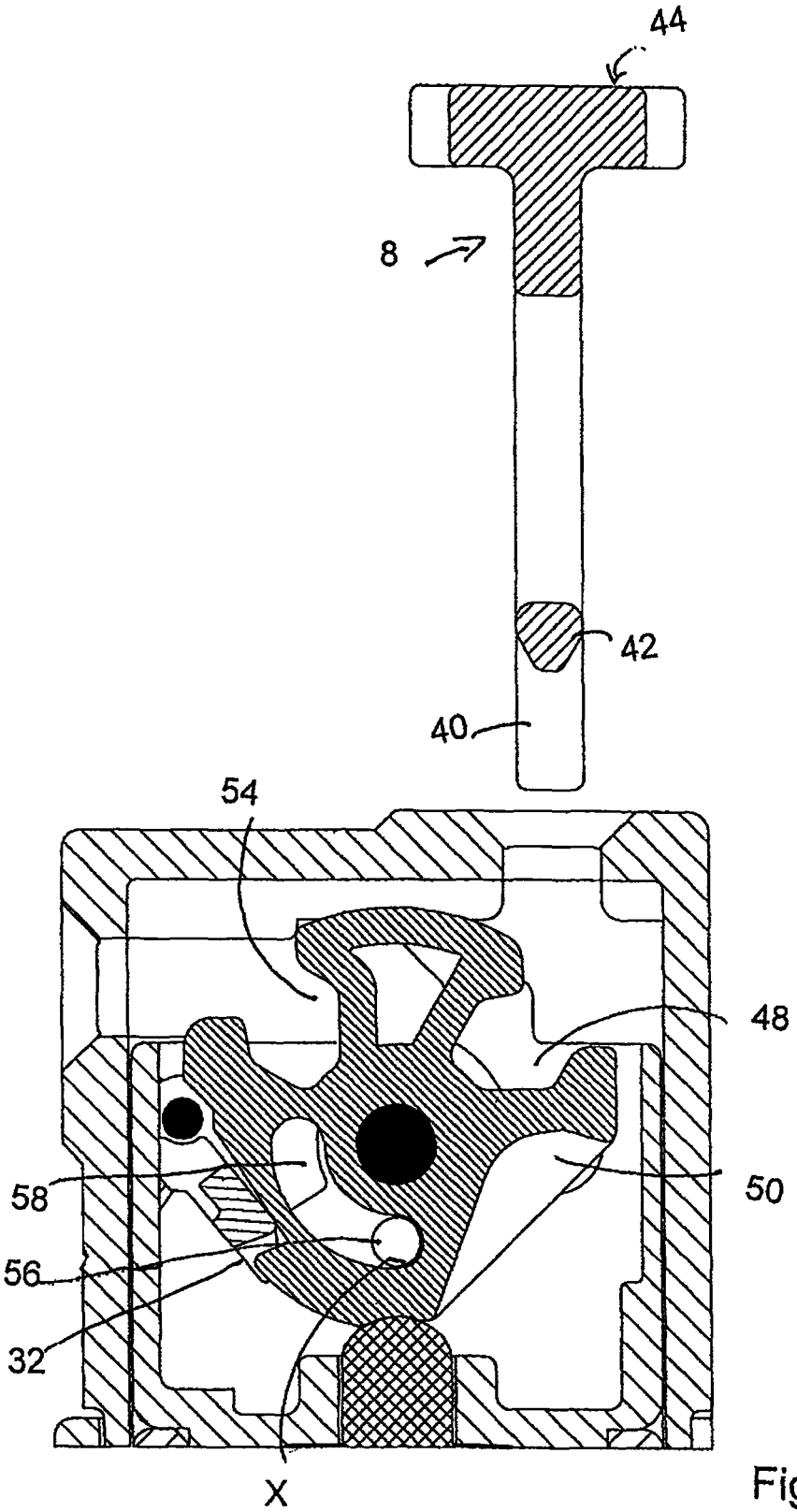
FIG. 13 is the same view as FIG. 8, but with the activator removed.

As best illustrated in FIGS. 11 to 13 each end lock release 22 carries a cam return spigot 56 which engages in a slot 58 provided in the side of the cam 12. The side cam slot 58 is a partial circle which is concentric with the longitudinal axis of the cam pin 14. A slot 58 is provided on each side of the cam 12 for receipt of a respective spigot 56 of the left and right end locks 22. This ensures that after withdrawal of the actuator 8 the position of the cam 12 is correct to ensure that the cam 12 is in the correct position to be locked by the locking arms 32.

As best illustrated in FIG. 12 (although described with respect to end entry of the actuator key, it is to be understood that the same principal will apply to front entry), during insertion of the actuator 8 the end lock release 22 rotates first causing the spigot 56 to move away from an abutment position X on one end of the slot 58. The spigot 56 during rotation no longer abuts the cam and the cam is free to rotate, with the spigot moving along the slot 58. When the actuator is withdrawn (FIG. 13), the actuator no longer presses on the end lock release 22 and because it is spring loaded 24, 26 it rotates back to its starting position. This causes its spigot 56 to move back along the slot 58 to once again abut the cam 12 at abutment position X at the end of the slot 58. The position X is located to ensure that the cam is moved by the spigot 56 to its correct position for engagement with the spring loaded locking arms 32 which engage in recess 36 on the cam profile.

It is to be understood that the invention is not intended to be restricted to the details of the above embodiment which are described by way of example only.

The invention claimed is:

1. A cam system used to selectively activate a switch by movement of a cam plunger between a first and second position, the plunger being moved between said first and second position by rotation of a cam between a corresponding first and second position of the cam, wherein the cam system comprises said cam, a locking system for locking said cam in said first cam position and a release system for unlocking the locking system enabling the cam to rotate to said second position, wherein the locking system comprises a separate mechanical lock on each side of the cam which must be unlocked by the release means before the cam can be rotated to the second position of the cam, and wherein each mechanical lock comprises two separate components which must be released in sequence to enable the unlocking of the cam.

2. A cam system according to claim 1, wherein the release means is adapted to release the mechanical locks simultaneously.

3. A cam system according to claim 1, wherein the two separate components comprise at least one lock release and at least one locking arm.

4. A cam system according to claim 3, wherein the lock release has means to receive the release system and an abutment means to move the locking arm after it is released.

5. A cam system according to claim 3, wherein the cam comprises a locking recess on its profile and the locking arm an arm portion which releasably engages in the locking recess.

6. A cam system according to claim 3, wherein the locking arm is spring loaded.

7. A cam system according to claim 3, wherein the cam is mounted for selective rotation on a cam pin, wherein the or each lock release is also mounted on the cam pin and is rotatable about the cam pin when the release means engages it.

8. A cam system according to claim 3, wherein the locking arm is mounted separate from the lock releases.

9. A cam system according to claim 3, wherein at least two lock releases are provided on each side of the cam each comprising a front and an end lock release, the front and end lock releases having corresponding abutment means which engage when one of these two lock releases is rotated to move the other of the lock releases.

10. A cam system according to claim 9, wherein the front and end lock releases respective means to receive the release system are orientated at different angles.

11. A cam system according to claim 10, wherein the angle may be 90°.

12. A cam system according to claim 3, wherein the cam system has means to return the cam to its initial position upon removal of the release means.

13. A cam system according to claim 12, wherein the return means comprises a return spring which acts on at least one of the lock releases and cam.

14. A cam system according to claim 12, wherein the return means includes a stop means to limit the rotation of the cam.

15. A cam system according to claim 14, wherein the stop means comprises a slot carried on the cam or lock release and a spigot which travels in the slot on the other of the lock release or cam.

16. A cam system according to claim 15, wherein the spigot and slot are provided coaxial to the rotational axis of the cam and lock release, at least one end of the slot providing an abutment for the spigot.

17. A cam system according to claim 1, wherein the release means comprises two separate dependent arms for respectively contacting the locking system either side of the cam.

18. A cam system according to claim 17, wherein the release means also comprises a cam mover downstream of the arms, which only contacts the cam for movement thereof once the locking means is released.

* * * * *